US008087762B2

(12) United States Patent
Takemura et al.

(10) Patent No.: US 8,087,762 B2
(45) Date of Patent: Jan. 3, 2012

(54) INK STORING SYSTEM AND INK DELIVERING SYSTEM

(75) Inventors: Masao Takemura, Kawasaki (JP); Kenta Udagawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 283 days.

(21) Appl. No.: 12/097,502

(22) PCT Filed: Nov. 29, 2007

(86) PCT No.: PCT/JP2007/073539

§ 371 (c)(1),
(2), (4) Date: Jun. 13, 2008

(87) PCT Pub. No.: WO2008/066204

PCT Pub. Date: Jun. 5, 2008

(65) Prior Publication Data

US 2009/0231399 A1 Sep. 17, 2009

(30) Foreign Application Priority Data

Nov. 29, 2006 (JP) ..... 2006-321515
Sep. 13, 2007 (JP) ..... 2007-237863

(51) Int. Cl.
*B41J 2/175* (2006.01)

(52) U.S. Cl. ..... 347/85

(58) Field of Classification Search ..... 347/84, 347/85, 86, 87
See application file for complete search history.

(56) References Cited

U.S. PATENT DOCUMENTS

| | | | | |
|---|---|---|---|---|
| 5,280,300 | A | 1/1994 | Fong et al. | 346/1.1 |
| 5,315,317 | A | 5/1994 | Terasawa et al. | 346/1.1 |
| 5,975,330 | A | 11/1999 | Sasaki et al. | 220/495.01 |
| 6,074,042 | A | 6/2000 | Gasvoda et al. | 347/50 |
| 6,203,146 | B1 | 3/2001 | Pawlowksi, Jr. | 347/85 |
| 6,471,343 | B1 | 10/2002 | Shimizu et al. | 347/85 |
| 6,612,683 | B2 * | 9/2003 | Takahashi et al. | 347/30 |
| 6,629,758 | B2 * | 10/2003 | Okamoto et al. | 347/85 |
| 6,742,877 | B2 | 6/2004 | Usui et al. | 347/85 |
| 6,976,753 | B2 * | 12/2005 | Kuwabara et al. | 347/86 |
| 2001/0040610 | A1 | 11/2001 | Kurata et al. | 347/85 |
| 2005/0068394 | A1 | 3/2005 | Inoue et al. | 347/93 |
| 2005/0088494 | A1 | 4/2005 | Shimizu et al. | 347/85 |
| 2005/0168520 | A1 | 8/2005 | Mantooth et al. | 347/30 |
| 2007/0109362 | A1 | 5/2007 | Hori et al. | 347/65 |

FOREIGN PATENT DOCUMENTS

| | | |
|---|---|---|
| EP | 840098 | 5/1998 |
| EP | 1231065 | 8/2002 |
| EP | 1270238 | 1/2003 |
| JP | 9-267483 | 10/1997 |
| JP | 10-244686 | 9/1998 |
| JP | 2003-159810 | 6/2003 |
| JP | 2005-59491 | 3/2005 |
| JP | 2005-161770 | 6/2005 |

* cited by examiner

*Primary Examiner* — Anh T. N. Vo
(74) *Attorney, Agent, or Firm* — Fitzpatrick, Cella, Harper & Scinto

(57) ABSTRACT

An ink reservoir mechanism includes a ink reservioring portion for directly reservoiring ink to be supplied to an ink jet recording head, the ink reservoiring portion having a reservoiring volume which reduces with consumption of the ink and being provided with an air-liquid separation device; a negative pressure source, having a variable inner volume, for normally applying a negative pressure to the ink reservoiring portion through the air-liquid separation device; and a connection path for connecting the negative pressure source and the ink reservoiring portion through the air-liquid separation device.

14 Claims, 10 Drawing Sheets

(a)

(b)

INK STORING SYSTEM AND INK DELIVERING SYSTEM

TECHNICAL FIELD

The present invention relates to an ink storing system equipped with an ink storage portion for storing the ink supplied from a main ink container to an ink jet recording head, which forms letters and/or pictorial images on recording medium by jetting liquid from liquid outlets, and an ink delivering system for supplying the ink jet recording head with the ink delivered from the main ink container. In particular, it relates to a combination of an ink storing system and an ink delivering system, which is equipped with a mechanism for purging the ink storage portion of the bubbles which occur in the ink storage portion.

BACKGROUND ART

In the case of an ink jet recording apparatus, ink is generally delivered to the recording head of the ink jet recording apparatus from an ink container through an ink delivery passage.

Because of the structure and/or the properties of the materials for an ink container and an ink delivery passage, it is unavoidable that air permeates through the walls of an ink container and/or ink delivery passage, and forms bubbles in the ink container and/or ink delivery passage. Further, it sometimes occurs that the changes in the ambient condition cause the air having dissolved into ink to form bubbles by separating from the ink. An ink container which does not have an ink absorbent member formed of a capillary substance, that is, an ink container which directly stores in its internal space, and the internal space of which is not in connection with the ambient air, is high in spatial efficiency, and also, can afford more latitude in ink selection, in terms of ink properties. However, if bubbles occur in an ink container of the abovementioned type, various problems occur.

For example, if it becomes impossible for an ink container of the above described type to maintain negative pressure because of the expansion of bubbles, ink leaks through the ink outlets of the recording head. Therefore, the internal space of an ink container of the abovementioned type has to be provided with a margin for bubble generation and bubble expansion. The provision of the margin increases an ink container in size. Further, if a bubble is trapped by a filter with which the ink delivery passage is provided, the ink delivery passage is virtually blocked by the trapped bubble, making it impossible for the ink delivery system to satisfactorily deliver ink. Therefore, the ink delivery passage and the filter therein have to be regularly subjected to a bubble extraction process. Moreover, if a bubble passes the filter and reaches the recording head, it prevents the recording apparatus from satisfactorily recording an image, or sometimes prevents the recording head from recording at all. If such a problem occurs, the bubbles in a recording head must be suctioned out or the recording head through the ink outlet.

Some ink jet recording apparatuses are provided with a subordinate ink container (which hereafter may be referred to as ink storage portion), in addition to an primary ink supply source (which hereafter may be referred to as main ink container, or simply as main container) which is not placed on a carriage. An ink storage portion is placed on a carriage and is connected to the recording head with the use of an ink delivery tube to supply the recording head with ink. If a bubble occurs in the subordinate ink container of an ink jet recording head of the above described type, it reduces the amount by which ink is delivered to the recording head. Thus, the subordinate ink container has to be regularly subjected to a process for extracting bubbles therefrom. In the case of the prior art for dealing with these problems described above, a subordinate ink container is made larger than necessary for storing a preset amount of ink, in order to tolerate the presence of a bubble.

In order to solve the above described problem, several proposals have been made regarding the method for removing a bubble from a subordinate ink container. According to one of the technologies in these proposals, for example, the bubbles in the ink delivery tube are made to float (separate from ink) and then, are suctioned out of the subordinate ink container, along with the ink in the ink delivery tube, by a pump (Japanese Laid-open Patent Application 2005-161770 (which corresponds to U.S. Patent Application No. 0088494/2005).

According to another of the technologies in the abovementioned proposals, it is determined with the use of an electrode whether or not the amount of the gas in the subordinate ink container is greater, than a preset value, and if the amount is greater than the preset value, the subordinate ink container is opened to the body of ambient air to force the gas out of the subordinate ink container by replenishing the subordinate ink container with ink (Japanese Laid-open Patent Application 2005-59491 (which corresponds to U.S. Patent Application No. 0109362/2007)

According to yet another of the technologies in the abovementioned-proposals, at the end of the process of replenishing a subordinate ink container with the ink from a primary ink supply source which is not on the carriage, the primary ink supply source is lowered to create a difference in head pressure, which is greater than the negative pressure in the subordinate ink container, so that a part of the body of ink in the subordinate ink container flows back, with bubbles, into the primary ink supply source until the amount of the negative pressure in the subordinate ink container falls to a value in a proper range (Japanese Laid-open Patent Application H10-244686 (which corresponds to U.S. Pat. No. 5,280,300, etc.).

Further, according to yet another of the technologies in the abovementioned proposals, a part of the tube for replenishing the subordinate ink container with ink is made of a substance capable of separating gas from the liquid in which the gas is contained, and the air in the body of ink in the tube is extracted by reducing the ambient pressure of the tube (Japanese Laid-open Patent Application 2003-159810 (which corresponds to J. S. Patent No. 6,742,877).

In the case of the technology disclosed in Japanese Laid-open Patent Application 2005-161770, which is for removing the bubbles in a subordinate ink container, it is unavoidable that the body of ink discharged with the bubbles when the bubbles are removed is wasted. In other words, this technology increases the operational cost of an ink jet recording apparatus. Further, this technology requires an absorbent member for absorbing and retaining the discharged ink, being therefore disadvantageous from the standpoint of reducing in size an ink jet recording apparatus. In the case of the technology disclosed in Japanese Laid-open Patent Application 2005-59491, a certain amount of space is necessary for measuring the amount of the gas with the use of an electrode, being therefore not suitable for reducing in size a subordinate ink container. In other words, this technology is not promising from the standpoint of spatial efficiency.

Further, the technology disclosed in Japanese Laid-open Patent Applications H10-244686, and 2005-161770 requires the primary ink supply source to be provided with a space for storing bubbles, in addition to the space for storing ink, making it necessary to increases in size the primary ink supply source. Thus, this technology is likely to increase an ink jet recording apparatus in size and cost. Moreover, in the case of the technology disclosed in Japanese Laid-open Patent Application 2003-159810, which employs a member for separating gas from the body of liquid into which the gas has dissolved, a bubble can be removed only when an ink jet recording apparatus is being driven, although ink is not wasted by the member for separating gas from the body of ink into which the gas has dissolved. Therefore, this technology is limited in terms of the condition under which a bubble can be removed.

As will be evident from the descriptions of the prior technologies given above, these technologies suffer from their own problems, but, are the same in that a bubble can be removed only when an ink jet recording apparatus is on. Therefore, if an ink jet recording apparatus is left for a long time without its power source turned on, as it is when an ink jet recording apparatus is kept in a storage, or left unused for a long time, the prior technologies are irrelevant.

Therefore, these technologies all tolerate the bubbles which generate in a subordinate ink container, and therefore, require a subordinate ink container to be larger in size than necessary for a preset amount of ink alone, making it difficult to realize a subordinate ink container which is significantly smaller in size than a subordinate ink container presently available. Further, increasing a subordinate ink container in storage size increases the subordinate ink container in the size of the interface between the body of ink therein, and the internal surface of the subordinate ink container. Therefore, the effect of the compatibility between the material for a subordinate ink container and the ink therein upon the performance of an ink jet recording apparatus (head) increases, limiting therefore the number of the substances selectable as the material for a subordinate ink container. Further, increasing a subordinate ink container in storage size is undesirable from the standpoint of the weight reduction of a subordinate ink container (it increases a subordinate ink container in weight).

DISCLOSURE OF THE INVENTION

Thus, the primary object of the present invention is to solve the problems described above in order to provide an ink storing system and an ink delivery system, which are capable of removing the bubbles in the subordinate ink container whether the power source of an ink jet recording apparatus is on or off, and also, even if an ink jet recording apparatus is left unused for a long time.

According to an aspect of the present invention, there is provided an ink reservoir mechanism comprising a ink reservoiring portion for directly reservoiring ink to be supplied to an ink jet recording head, said ink reservoiring portion having a reservoiring volume which reduces with consumption of the ink and being provided with an air-liquid separation device; a negative pressure source, having a variable inner volume, for normally applying a negative pressure to said ink reservoiring portion through said air-liquid separation device; and a connection path for connecting said negative pressure source and said ink reservoiring portion through said air-liquid separation device.

According to another aspect of the present invention, there is provided an ink supplying system for supplying ink from an ink container to an ink jet recording head, said system an ink reservoiring portion for directly reservoiring ink to be supplied to an ink jet recording head, said ink reservoiring portion having a reservoiring volume which reduces with consumption of the ink and being provided with an air-liquid separation device; a negative pressure source, having a variable inner volume, for normally applying a negative pressure to said ink reservoiring portion through said air-liquid separation device; a connection path for connecting said negative pressure source and said ink reservoiring portion through said air-liquid separation device; a displacement mechanism for displacement in a direction of reducing an inner volume of said negative pressure source; and a main container for reservoiring ink to be supplied to said ink reservoiring portion.

The ink storage portion of an ink jet recording head employed by an ink jet recording apparatus, in which the ink to be supplied to an ink jet recording head is directly stored, is provided with a gas permeable member, that is, a member capable of separating gas from liquid. Further, a negative pressure source is connected to the ink storage portion with the use of a connective passage providing member, with the interposition of the gas permeable member between the negative pressure source and ink storage portion, so that the ink storage portion always remains under the negative pressure from the negative pressure source through the gas permeable member. Therefore, the ink storage portion always remains under the negative pressure from the negative pressure source, with the presence of the gas permeable member between the negative pressure source and ink storage portion, not only when an ink jet recording apparatus is in operation, but also, when the ink jet recording apparatus is not in operation, for example, when the power source of the ink jet recording apparatus is off, or the ink jet recording apparatus is kept in storage for a long period of time. Therefore, whenever a bubble occurs in the ink storage portion, the bubble is immediately moved out of the ink storage portion through the gas permeable member. Thus, it does not occur that bubbles collect in the ink storage portion. Therefore, it does not occur that a bubble expands in the ink storage portion while the ink container is left unattended for a long period of time. In other words, the present invention makes it possible to provide an ink storage system and an ink delivery system, which can prevent the problem that while an ink jet recording apparatus is left unattended for a long period of time, ink leaks from its ink jet recording head through the ink jetting nozzles.

In the past, as the number and/or volume of bubbles in the abovementioned ink storage portion exceeds a preset value, the operation for removing the bubbles from the ink storage portion was carried out. However, according to the present invention, as soon as a bubble occurs in the ink storage portion, it is immediately removed from the ink storage portion, as long as the negative pressure accumulating-and-storing portion holds negative pressure. Thus, the present invention makes unnecessary the operation dedicated to the bubble removal from the ink storage portion, affording an ink jet recording apparatus designer more latitude in terms of the operational sequence of an ink jet recording apparatus.

Further, the present invention makes it unnecessary to make the storage space of ink storage portion larger than the exact size necessary for storing a preset amount of ink. In other words, the present invention can improve the ink storage portion in spatial efficiency.

Further, the present invention can reduce the size of the ink storage portion by the amount equal to the volume of the bubble(s) in the ink storage portion, which has been taken into consideration when designing the ink storage portion in the past. Thus, the present invention makes it possible to significantly reduce the amount by which the flexible sheet is flexed, affording an ink jet recording apparatus designer more latitude, concerning the tolerance of the flexible sheet against repetitive deformation. Moreover, the reduction in the amount by which flexible sheet is flexed makes it possible to design an ink jet recording apparatus, the ink storage portion of which is significantly more stable in negative pressure than that of an ink jet recording apparatus in accordance with the prior art.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Embodiment 1

First, referring to FIG. 1 the general structure of the ink jet recording apparatus in the first embodiment of the present invention will be described.

Figure 2:
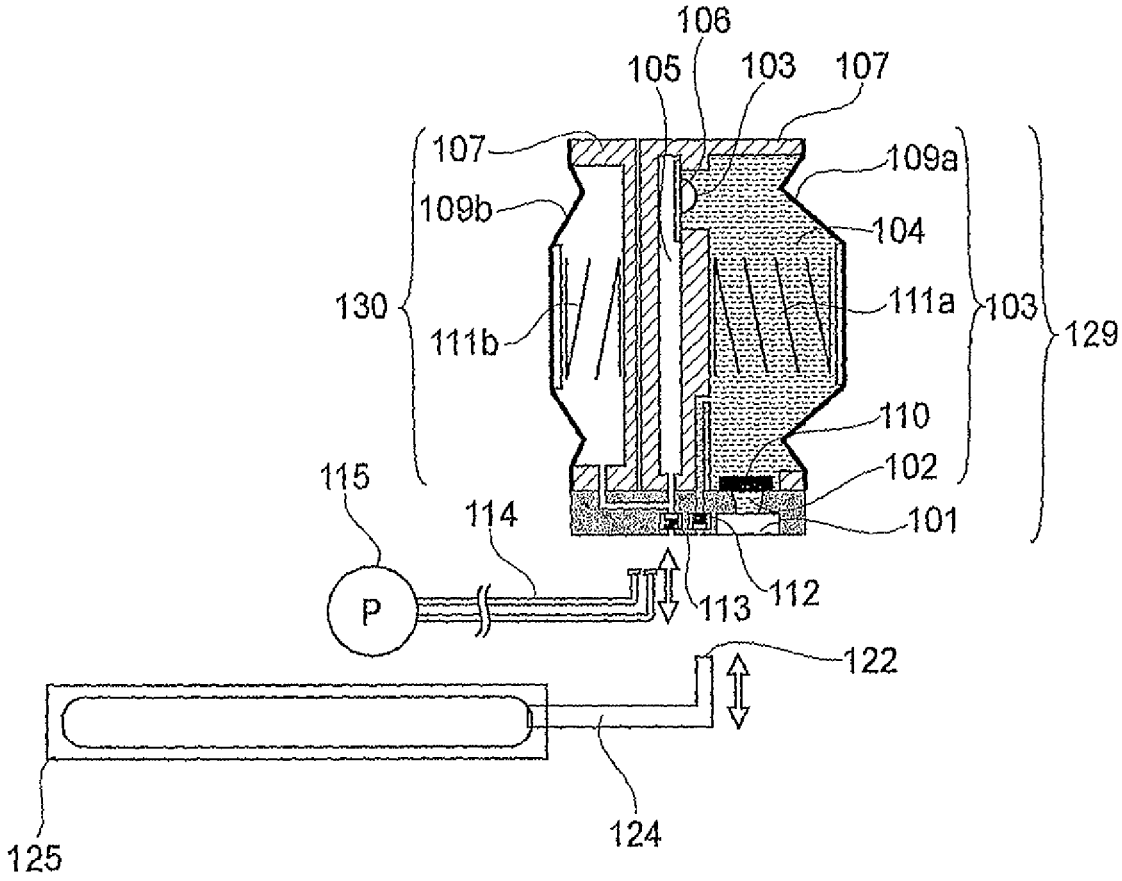
FIG. 2 is a schematic drawing of the ink delivery system, in the first embodiment, which intermittently delivers ink.

The ink jet recording apparatus in this embodiment of the present invention has a recording head (unshown), an ink supply source 125 as a main ink container, a subordinate ink container 103 (ink storage portion), and a carriage 119. It is structured so that the subordinate ink container 103 is mounted on the carriage 119, whereas the ink supply source 125 is located off the carriage 119. Thus, the ink jet recording apparatus is provided with an ink delivery tube 124 for guiding the ink in the main container 125 to a preset location, and a connective portion 122, by which the ink delivery tube 124 is connected to the subordinate ink container 103 in order to deliver the ink to the subordinate ink container 103. The ink jet recording apparatus is structured so that as the carriage 119 is moved to a home position or a preset location, the ink delivery passage is temporarily established between the subordinate ink container 103 and the ink supply source 125 through the connective portion 122 to supply the subordinate ink container 103 (ink jet recording head) with ink as necessary. For descriptive convenience, an ink jet recording apparatus employing this type of ink delivery system may be referred to as an ink jet recording apparatus of the intermittent ink delivery type. FIG. 2 is a schematic sectional view of the essential portion of the ink delivery system of the intermittent type, showing the structure of the portion.

Figure 1:
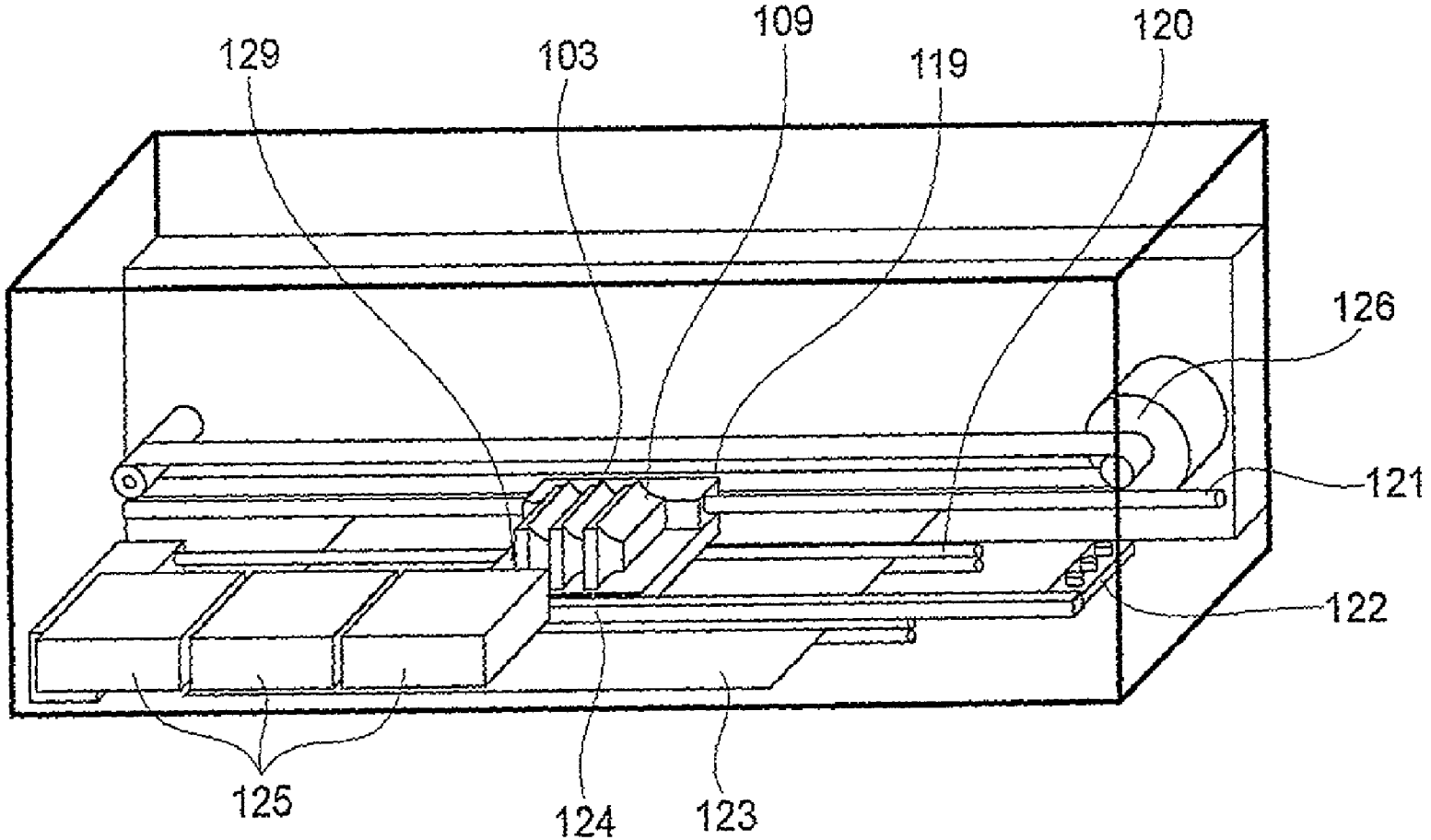
FIG. 1 is a schematic perspective view of an ink jet recording apparatus which employs an ink delivery system, in accordance with the present invention, which intermittently delivers ink.

Referring to FIG. 1, the ink jet recording head (unshown in FIG. 1; portion 111 in FIG. 2) for recording on a recording medium 123 conveyed by a sheet conveying roller 120 is on the carriage 119, which is reciprocally movable along a guiding shaft 121 by the movement of a driver belt connected to a motor 126. A recording head unit 129 is provided with a small ink container 103 in which negative pressure is cumulatively generated and stored. The small ink container 103 (which hereafter may be referred to simply as ink container 103) is an integral part of the recording head unit 129. One of the walls of the ink container 103 is made up of a sheet of flexible is film 109*a* (which hereafter may be referred to as flexible sheet) (FIG. 2), allowing thereby the ink container 103 to change in the size of its internal space. It is also provided with a spring (unshown in FIG. 1; portion 111*a* in FIG. 2) as an elastic member for generating negative pressure in the ink container 103. The ink supply source 125 for replenishing the ink container 103 with ink by the amount, by which ink was consumed therefrom, is in the front portion of the in), jet recording apparatus.

Next, referring to FIGS. 2 and 3, the operation for intermittently supplying the ink container 103 of this ink jet recording apparatus with ink will be described. FIG. 1 schematically shows the structures of the ink supply source 125, ink delivery tube 124, and ink jet recording head unit 129.

When the amount of ink in the ink container 103 falls below a preset value due to the ink consumption resulting from printing, the carriage 119 is moved to its home position where the ink jet recording head unit 129 is connectible to the ink supply source 125, and is stopped there. While the carriage 119 is in this position, the connective portion 122 of the ink delivery tube 124 is connected to the refill ink inlet (unshown in FIG. 1; portion 112 in FIG. 2), with which the ink jet recording head unit 129 is provided. Referring to FIGS. 2 and 3, meanwhile, a suction pump 115 as a negative pressure generating first source is connected to an air outlet 113 of the ink jet recording head unit 129 through a connective tube 114. The air outlet 113 is provided with a one-way valve which opens as the suction pump 115 is activated after the connection of the connective tube 114 to the air outlet 113. Thus, as the suction pump 115 is activated, ink is delivered from the ink supply source 125 to the ink container 103 through the ink delivery tube 124 by the negative pressure generated by the spring with which the ink container 103 is provided. In the case of an ink delivery system, such as the above described system, which intermittently supplies an ink jet recording head (more specifically, small ink container of ink jet recording head) with ink, it is only a recording head and a small ink container of an ink jet recording head unit that must be supported by a carriage. Thus, the employment of this ink delivery system makes it possible to reduce a carriage in size and weight. Therefore, it can reduce an ink jet recording apparatus in overall size.

Next, referring to FIG. 3 which is a schematic sectional view of the ink jet recording head unit 129 provided with an ink storing system in accordance with the present invention, the structure of the ink jet recording head unit 129 will be described. The ink jet recording apparatus in this embodiment is structured so that multiple ink jet recording head units 129, which are different in the color (cyan, magenta, and yellow, for example) of the ink therein, can be mounted in the main assembly of the apparatus. However, for the simplification of FIG. 3, only a single ink jet recording head unit 129 is shown in FIG. 3.

Figure 3:
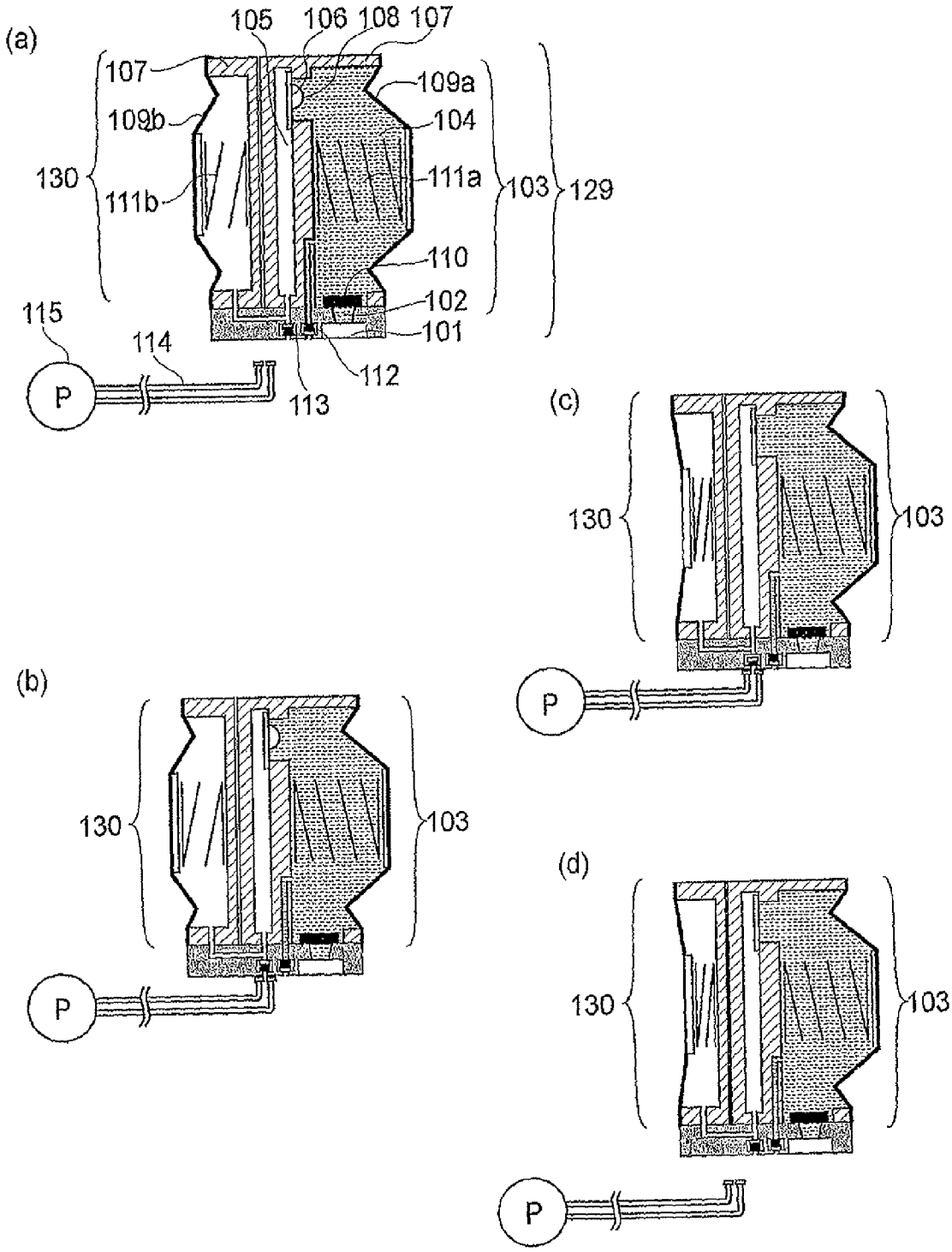
FIGS. 3(*a*)-3(*d*) are schematic sectional views of the ink delivery system in the first embodiment of the present invention, showing the states of the ink delivery system before the ink jet recording head is connected to the suction pump, immediately after the ink jet recording head is connected to the suction pump, while the suction pump is in operation, and immediately after the suction pump is disconnected from the ink jet recording head after the cessation of the operation of the suction pump, respectively.

Referring to FIG. 3, the ink jet recording head unit 129 in this embodiment is provided with the ink container in which ink is stored after being delivered thereto from the ink supply source 125 in the ink jet recording apparatus, and a recording head 101 for jetting the ink delivered from the ink container 103. The ink container 103 has an ink storage portion 104 (storage space) in which ink is stored, an air discharging passage 105, through which bubbles 108 having collected in the ink storage portion 104, and a gas permeable member for separating gas from liquid, which is positioned between the ink storage space 104 and air discharging passage 105. As the material for the gas permeable member 106, porous film formed of polytetra-fluoro-ethylene treated for water- and oil repellence, or the like film, can be used. This gas permeable member 106 is securely welded to the shell 107 of the ink jet recording head unit 129, which serves as the frame of the ink jet recording head unit 129. The ink storage portion 104 is made up of the shell 107 and very flexible film 109*a*, being therefore variable in internal volume. The flexible film 109*a* repeatedly deforms in response to the ink consumption from the small ink container 103 or the replenishment of the small ink container 103 with ink. The ink storage portion 104 has an ink outlet 102 through which ink is delivered from the ink storage portion 104 to the recording head 101, and an ink inlet through which the ink storage portion 104 is refilled with the ink from the ink supply source 125. Further, the ink storage portion 104 is provided with an elastic member, which is positioned in the ink storage portion 104 to generate a proper amount of negative pressure for maintaining a meniscus in the ink outlet.

On the other hand, an air discharging passage 105 for discharging a bubble 108 (or bubbles 108) having accumulated in the ink storage portion 104 is positioned next to the ink storage portion 104 (ink storage space). The air discharging passage 105 is connected to the air outlet 113 which has a valve. As for the positioning of this valve, one end of the connective tube 114 is attached to the suction pump 115, and the other end is to be connected to the air outlet 113. It is in the outward end of this outlet 113 where this valve is positioned. The valve is a one-way valve which opens only when the internal space of the connective tube 114 is reduced in pressure by the suction pump 115 after the connection of the connective tube 114 to the air outlet 113.

A negative pressure accumulating-and-storing portion 130 (which hereafter will be referred to simply as negative pressure storing portion 130), which is the second negative pressure source, is in connection to the air discharging passage 105. It is an integral part of the ink container 103, which is mounted on the carriage. The negative pressure storing portion 130 is made up of the shell 107 and a very flexible film 109*b*. The negative pressure storing portion 130 is provided with a spring 111*b* (elastic member) for generating negative pressure in the negative pressure storing portion 130.

Figure 4:
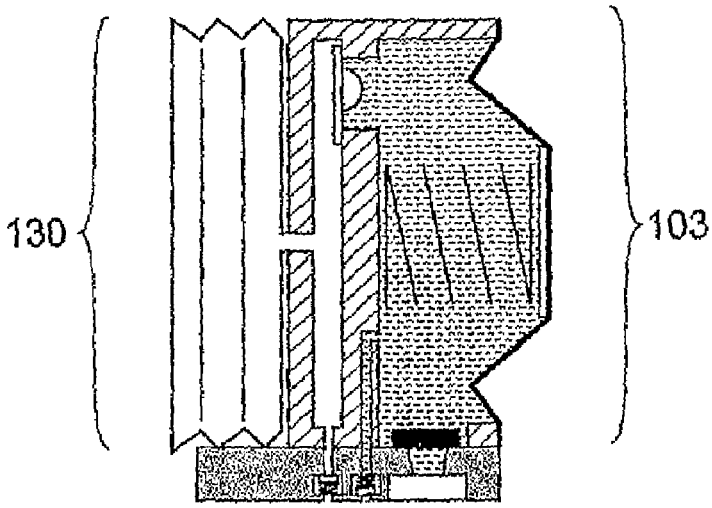
FIG. 4(*a*) is a sectional view of the negative pressure accumulating-and-storing portions in the first embodiment of the present invention, which is made up of a bellows, and FIG. 4(*b*) is a schematic sectional view of the negative pressure accumulating-and-storing portion made up of a combination of a piston and a cylinder, showing the structures of the two negative pressure generating portions, respectively.
Figure 4:
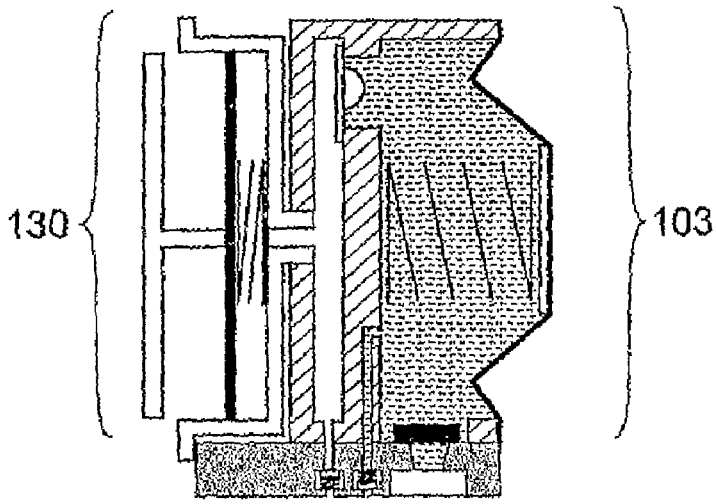

The negative pressure storing portion 130 in this embodiment of the present invention does not come into contact with ink. Therefore, when selecting the materials for the negative pressure storing portion 130, the compatibility between the material for the negative pressure storing portion 130 and ink does not need to be taken into consideration. Thus, the materials for the negative pressure storing portion 130 may be selected from among a wide range of substances, and the structural design for the negative pressure storing portion 130 may be selected from among a wide range of structural designs. Therefore, the structure of the negative pressure storing portion 130 in this embodiment of the present invention does not need to be limited to that shown in FIG. 1. For example, the negative pressure storing portion 130 may be replaced with a negative pressure storing portion shown in FIG. 4(*a*), or a negative pressure storing portion shown in FIG. 4(*b*). The former is structured like a bellows, and generates negative pressure as it is stretched. The latter is made up of a cylinder, a piston, and an elastic member, such as a spring, and generates negative pressure as the piston is moved in the cylinder in a preset direction by the elastic member.

Next, the operation for removing the bubble 108 (which is made up of various gases accumulated in the ink storage space 104) from the ink storage space 104 will be described. The gas permeable member 106 is located in the portion of the ink storage space 104, in which the gases in the ink containers 103 are likely to settle. For the purpose of ensuring that the bubble 108 settles in the immediate adjacencies of the gas permeable member 106, the ink container 103 is desired to be structured so that the bubble 108 is likely to collect in the immediate adjacencies of the gas permeable member 106.

When the recording head unit 129 is not recording an image, it is on standby in its home position (FIG. 3(*a*)) in which it is connectible to the ink supply source 125. It is when the recording head unit 129 is in this position that the bubble 108 is removed. More specifically, the connective portion, that is, the end portion, of the connective tube 114 which is in connection to the suction pump 115 is connected to the outward end, that is, the connective portion, of the air outlet 113, and then, the generation of negative pressure in the air discharge passage 105 is started (FIG. 3(*b*)). If the bubble 108 is in contact with the gas permeable member 106 at this point in time, the bubble 108 is separated from the body of ink in the ink storage space 104 by the gas permeable member 116, and is discharged from the recording head unit 129 through the air discharging passage 105. That is, only the bubble 108 is discharged. Further, the negative pressure generated in the connective tube 114 also acts on the negative pressure storing portion 130, causing the flexible film 109*b* of the negative pressure storing portion 130 to deform in the direction to store negative pressure in the negative pressure storing portion 130 (FIG. 3(*c*)). Then, after the lapse of a preset length of time, the pressure reduction by the suction pump 115 is stopped, and the connective tube 114 is disconnected from the air outlet 113 (FIG. 3(*d*)).

As described above, the above described operation causes the negative pressure storing portion 130 to function as a negative pressure source for the ink container 130 even after the negative pressure generating operation is ended. Therefore, even after the operation for reducing internal pressure of the negative pressure storing portion 130 by driving the suction pump 115 is stopped, negative pressure is maintained in the air discharging passage 105 by the negative pressure storing portion 130. Therefore, as soon as the bubble 108 having generated in the ink storage space 104 comes into contact with the gas permeable member 106, it is moved into the air discharging passage 105, being prevented from accumulating in the ink storage space 104.

With the employment of the above described structural arrangement, the bubbles can be continuously removed from the ink storage space 104 without wasting ink, not only when the ink jet recording apparatus is on, for example, when it is printing or on standby, but also, when it is off (for example, while it is left unused for a long time without being turned on). Therefore, it does not occur that the internal pressure of the ink container 103 fluctuates due to the expansion or contraction of the bubble in the ink container 103. Therefore, it is possible to provide an ink delivery system and an ink jet recording apparatus, which are highly reliable in that they do not contribute to the unsatisfactory printing and the leaking of ink from the nozzles. Further, bubbles are continuously removed from the ink container 103. Therefore, an operation dedicated to the bubble extraction is unnecessary. Therefore, more latitude is afforded to an ink jet recording apparatus designer, concerning the operational sequence for an ink jet recording apparatus. Further, the employment of the above described structural arrangement makes it unnecessary to take into consideration the amount by which the internal space of the ink container must be dedicated to bubble expansion and accumulation. Therefore, it can significantly improve an ink container in spatial efficiency. Further, in this embodiment, a bubble is removed with the use of the gas permeable member. Therefore, the bubble removing operation automatically ends as soon as a bubble is removed. Therefore, a sensor dedicated to the detection of the completion of the bubble removing operation is not required.

As for additional effects of the present invention, the ink storage portion can be reduced in size by the amount by which the internal space of the ink container in accordance with the prior art had to be dedicated to bubble expansion and accumulation. Therefore, the amount by which the flexible film is required to deform can be reduced. Therefore, more latitude is afforded to an ink jet recording apparatus designer, concerning the durability of the flexible film against the repetitive deformation. Further, the reduction in the amount by which the flexible film is required to flex makes it possible to design the ink container (flexible film) to be more stable in negative pressure. Further, the structural arrangement makes the flexible film last loner, making it possible to use, as the material for the flexible film, substances softer than the substances used as the materials for the flexible film in accordance with the prior art. Therefore, the material for the flexible film in this embodiment can be selected from among a wider range of substances. Generally, the softer the material for film, the higher in permeability the film is likely to be. According to the present invention, various gases having entered the ink container through the flexible film can be continuously removed. Therefore, when selecting the material for the flexible film of the ink container in this embodiment, the effect of the gas permeability does not need to be taken into consideration as much as it has to be when selecting the material for the flexible film of an ink container in accordance with the prior art. Further, also according to the present invention, the suction pump can be kept away from the negative pressure storage portion while the carriage is in motion. Therefore, the bubble in the ink storage portion can be removed without adding to the load to which the carriage is subjected when it is moved.

Figure 5:
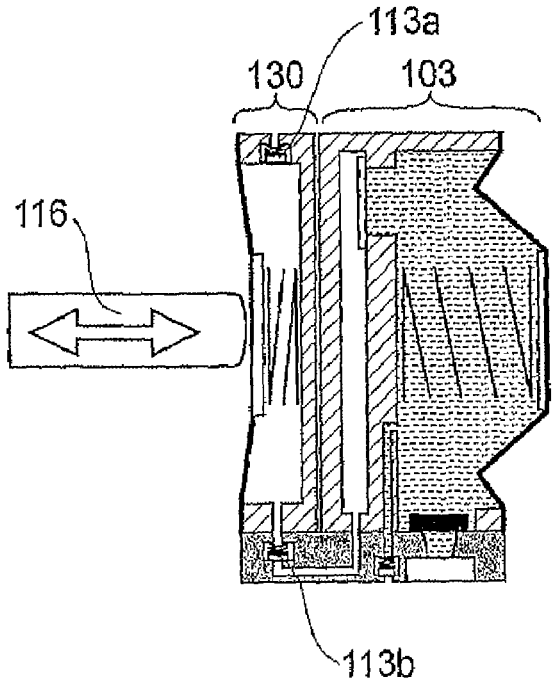
FIG. 5 is a schematic sectional view of the negative pressure accumulating-and-storing portion structured to use a pressing mechanism to generate and accumulate negative pressure in the negative pressure accumulating-and-storing portion, showing the structure of the portion.
Figure 6:
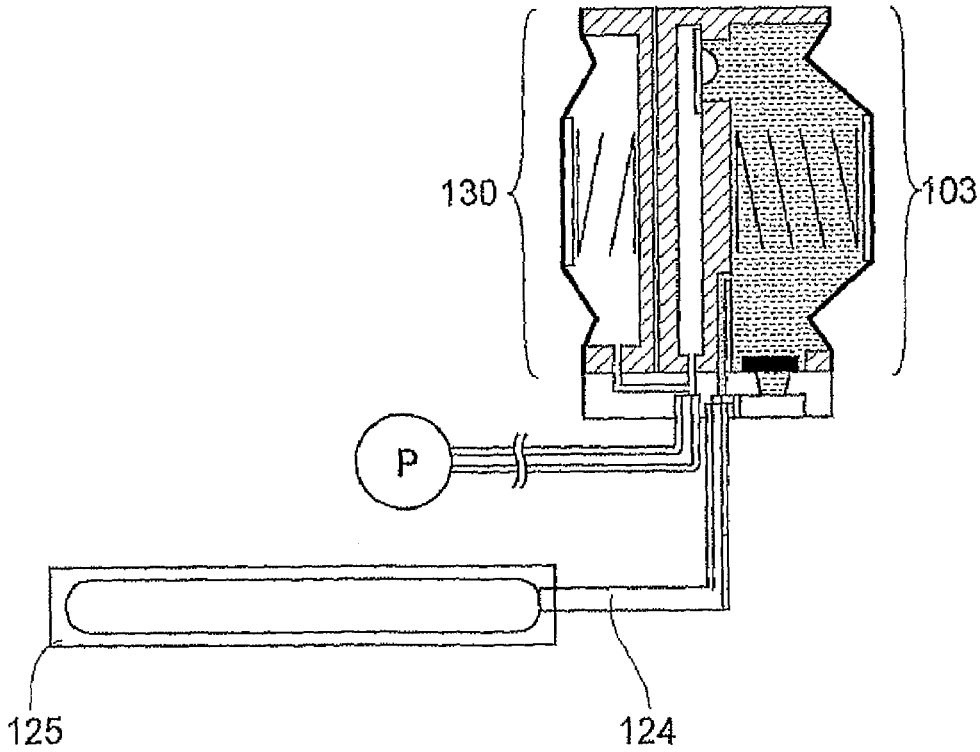
FIG. 6 is a schematic sectional view of the ink delivery system which continuously delivers ink, showing the structure of the system.

Incidentally, in this embodiment of the present invention described above, the structural arrangement for removing a bubble from the ink storage space was such that the suction pump 115 was intermittently connected to the negative pressure storing portion 130 to generate negative pressure in the negative pressure storing portion 130. However, the means for removing a bubble from the ink storage space may be structured as shown in FIG. 5. That is, the flexible film 109*b* of the negative pressure storing portion 130 is pressed, as necessary, by a pressing mechanism 116 which mechanically presses the flexible film 109*b* so that as the spring 111*b* of the negative pressure storing portion 130 is deformed by the pressing member 116, the air in the negative pressure storing portion 130 is discharged by a certain amount, and also, so that as the pressure applied by the pressing mechanism 116 is removed, negative pressure is generated in the ink storage space 104. In this case, the negative pressure storing portion 130 is provided with a one-way valve 113*a* which allows the air in the negative pressure storing portion 130 to flow out into the ambience, and a one-way valve 113*b* which allows the air in the air discharge passage 105 to move into the ink storage space 104. Obviously, the means for pressing the flexible film 109*b* does not need to be limited to a mechanical means such as the above described pressing mechanism 116. For example, the means for pressing the flexible film 109*b* may be made up of a cover which hermetically covers the flexible film 109*b*, and a compressor pump, so that negative pressure can be generated in the negative pressure storing portion 130 by increasing the air pressure between the flexible film 109*b* and cover. In other words, as long as negative pressure can be generated in the negative pressure storing portion 130, the structure of the means for generating negative pressure in the negative pressure storing portion 130 does not need to be limited to those described above. Needless to say, the structural design of the negative pressure storing portion 130 may be replaced by the one shown in FIG. 4(*a*) or the one shown in FIG. 4(*b*). Incidentally, in this embodiment of the present invention, the present invention was described with reference to the ink jet recording apparatus employing the intermittent ink delivery system. However, the application of the present invention is not limited to this type of ink jet recording apparatus. That is, the present invention is applicable to an ink jet recording apparatus employing a continuous ink delivery system, the main ink container and subordinate ink container of which are always kept connected to each other for continuous ink delivery, by a connective tube, as long as the ink container of the ink jet recording apparatus employs a gas permeable member (gas extracting member). FIG. 6 shows the structure of one of the examples of such an ink jet recording apparatus. As will be evident from FIG. 6, one end of the connective tube 114 is always kept connected to the suction pump 115, whereas the other end is always kept connected to the outward end of the air outlet 113. Further, the ink delivery tube is always kept connected to the ink inlet 112. In the case of an ink delivery system, such as the above described one, the suction pump of which is always kept connected to the ink container, more latitude is afforded to the positioning of the suction pump.

Further, the present invention is also applicable to an ink jet recording apparatus, the main ink container of which is mounted on its carriage, as long as its ink container has a gas permeable member (gas extracting member).

Further, this embodiment is described with reference to the ink jet recording head unit 129, the gas permeable member 106 of which is vertically positioned. However, for the purpose of utilizing the buoyancy of the bubble 108 to make it more likely for the bubble 108 to come into contact with the gas permeable member 106, the gas permeable member 106 may be horizontally positioned across a hole with which the top wall of the ink storage portion 104 is provided.

Figure 7:
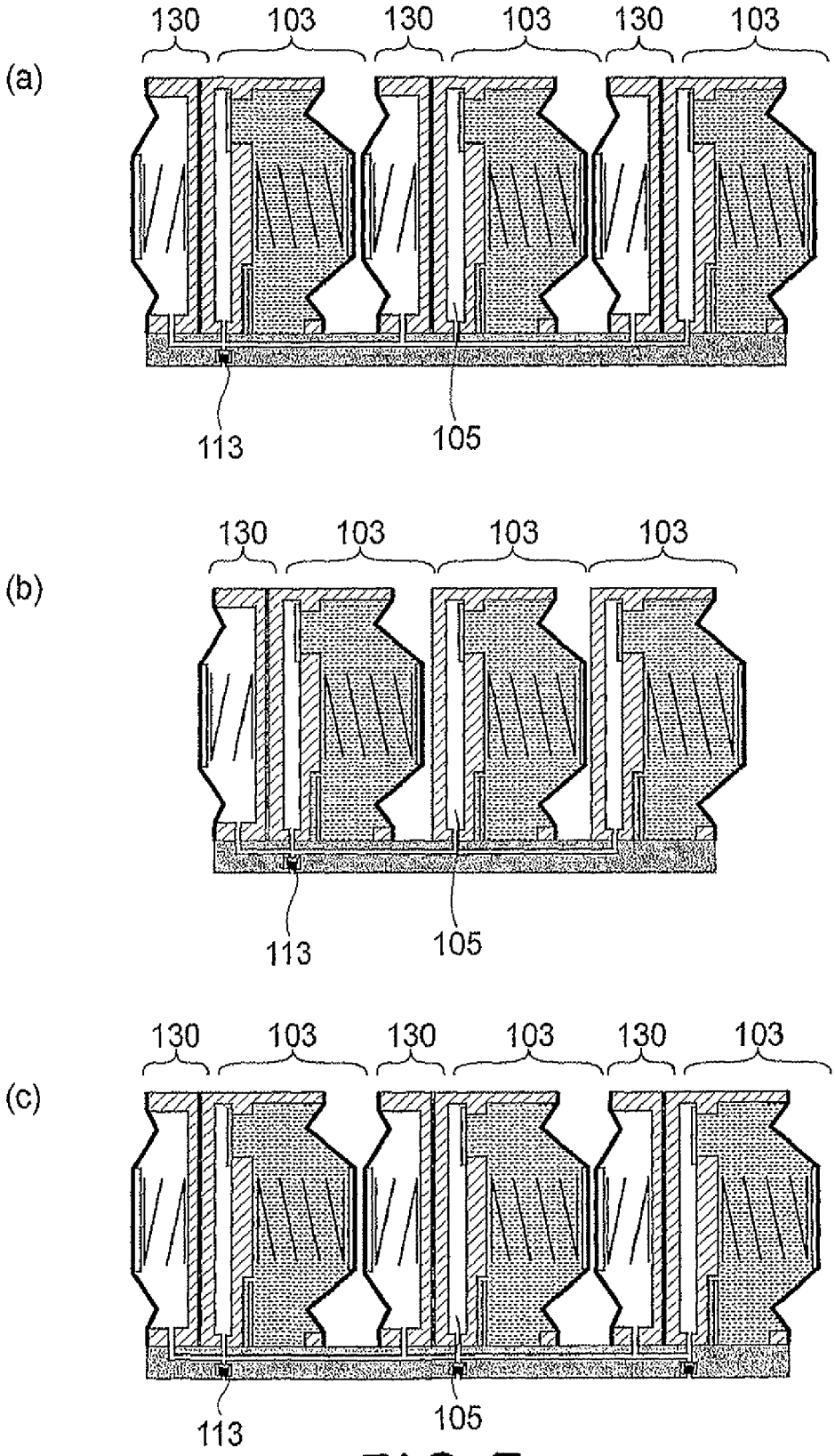
FIGS. 7(*a*)-7(*c*) are sectional views of the ink jet recording heads, in the first embodiment of the present invention, which comprise multiple subordinate ink containers, showing the structures of is the heads, respectively.

Further, the present invention is compatible to a recording head unit 129 shown in FIG. 7(*a*), which comprises multiple ink containers 103, different in the color of the ink therein. More specifically, this recording head unit 129 is provided with a common air (gas) passage to which the air discharge passage 105 of each ink container 103 is connected, and each ink container 103 is provided with its own negative pressure storing portion 130. In other words, this recording head unit 129 has multiple negative pressure storing portions 130. Thus, should a given negative pressure storing portion 130 reduce in negative pressure, the negative pressure storing portion 130 is compensated for the reduced negative pressure by the other negative pressure storing portions 130 through the common gas passage. Moreover, the present invention is compatible with a recording head unit 129 shown in FIG. 7(*b*), which is provided with only a single negative pressure storing portion 130, which is shared by multiple ink containers 130. In the case of this recording head unit 129, the single negative pressure storing portion 130 can remove bubbles from multiple ink containers 130 by being connected to the multiple ink containers 130 through the common gas passage. Therefore, when the recording head 101 has to be increased in the number of inks it uses, it does not need to be increased in size as much as the recording head unit 129 shown in FIG. 7(*a*). Further, the present invention is also compatible with a recording head shown in FIG. 7(*c*), which comprises multiple ink containers 130, the air discharging passages of which are independent from each other. In this case, it does not occur that the ink vapor generated in the air discharging passage 105 of one of the multiple ink containers 103 mixes with the ink vapor generated in the air discharging passage 105 of another ink container 103. Therefore, this structural arrangement is suitable for an ink jet recording head unit in which the ink vapor from one ink is likely to react with the ink vapor from the other inks.

It is needless to say that the ink delivery systems (intermittent ink delivery system, continuous ink delivery system), the structures of the negative pressure storing portion 130, the structures of the means for generating negative pressure in the negative pressure storing portion 130, which were described above, are compatible with any of the embodiments of the present inventions, which will be described next, and also, that they may be modified, as necessary, for their application to the following embodiments.

Embodiment 2

Figure 8:
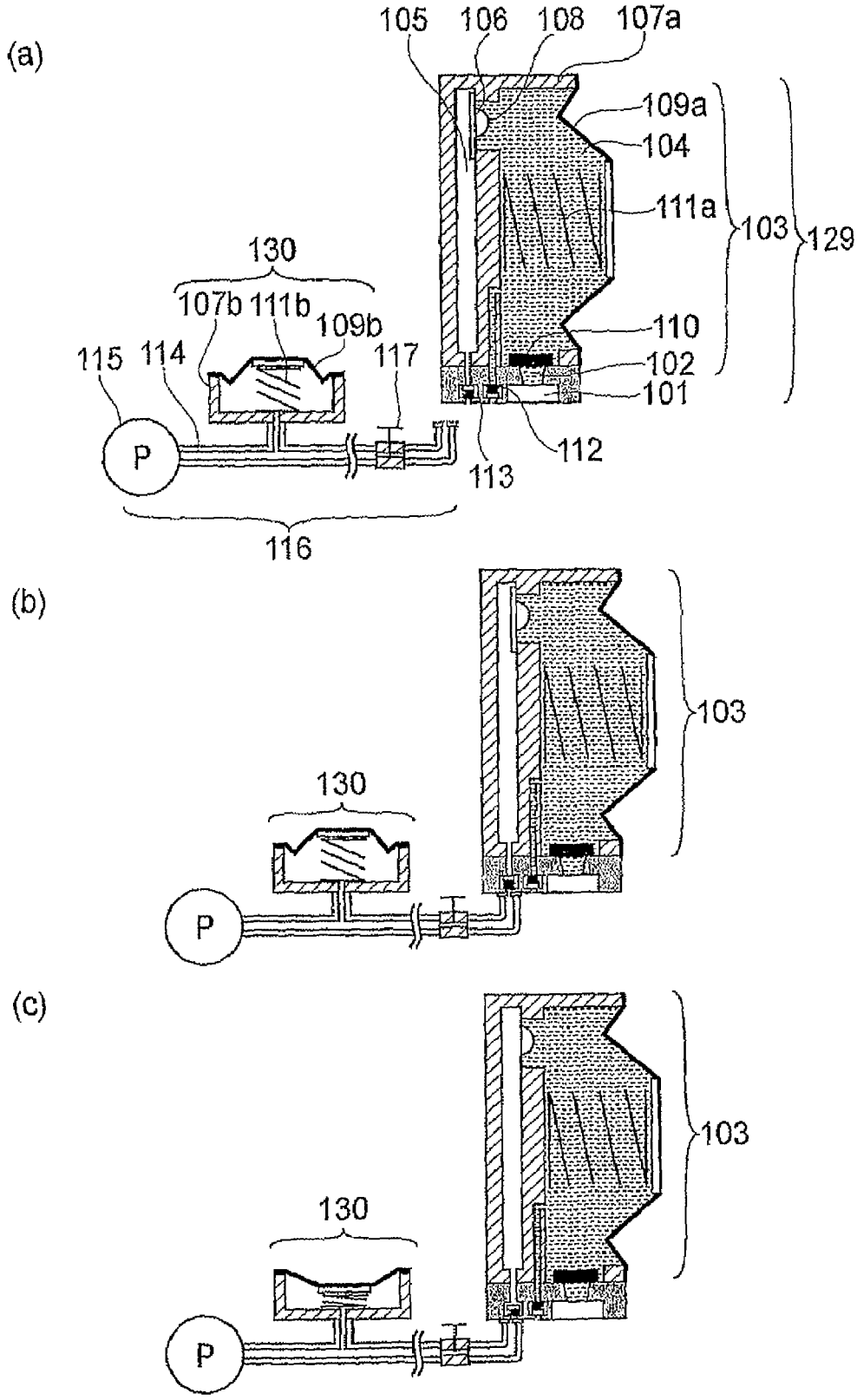
FIGS. 8(*a*)-8(*c*) are sectional views of the ink delivery system, in the second embodiment of the present invention, showing the states of the ink delivery system before the ink jet recording head is connected to the suction pump, immediately after the ink jet recording head is connected to the suction pump, and while the suction pump is in operation, respectively.

FIGS. 8(*a*)-8(*c*) are schematic sectional views of the recording head cartridge and gas purging unit in the second embodiment of the present invention.

The ink container 103 in this embodiment is the same in structure as that in the first embodiment. However, the negative pressure storing portion 130 in this embodiment is different from that in the first embodiment, in that it is a part of the main assembly of an ink jet recording apparatus.

This negative pressure storing portion 130 is connected to a connective tube 114 (gas passage) which is in connection with the suction pump 115. In terms of the lengthwise direction of the connective tube 114, the negative pressure storing portion 130 is positioned near the home position the recording head unit, and serves as a gas purging unit 116. The gas purging unit 116 is connectible with the air outlet 113 of the ink container 103. When the ink jet recording apparatus is not recording, for example, while it is on standby, more specifically, while the recording head unit is in its home position, the air purging unit 116 is kept connected to the air outlet 113. The air purging unit 116 is provided with a valve 117, which operates in such a manner that it opens only when the air purging unit 116 is in connection with the air outlet 113 (it does not open when the air purging unit 116 is not in connection with the air outlet 113).

Next, the air purging unit 116, that is, the negative pressure storing portion 130 in this embodiment, will be described with regard to its operation for purging a bubble 108 in the ink storage space 104 into the ambience. When the ink jet recording head is not recording (FIG. 8(*a*)), the recording head unit 129 is on standby in its home position, in which it is connectable with the external ink supply source 125. It is while the recording head unit 129 is on standby that the generation of negative pressure in the air discharging passage 105 by the air purging unit 116 is started by connecting the air purging unit 116 to the air outlet 113 and opening the valve (FIG. 8(*b*)). If the bubble 108 in the ink storage space 104 is in contact with the gas permeable member 106 during this period, only the bubble 108 is extracted into the air discharging passage 105; it is separated from the body of ink in the ink storage space 104. Further, as negative pressure is generated in the air discharging passage 105, the flexible film 109*a* begins to flex in the direction to reduce the ink storage space 104 in internal space, causing thereby the negative pressure storing portion 130 to store negative pressure (FIG. 8 (*c*)). Then, after the lapse of a preset length of time, the generation of negative pressure by the air purging unit 116 is stopped. When the recording head unit 129 is not recording, the recording head unit 129 is in its home position, and the air purging unit 116 is in connection with the air outlet 113. Therefore, even if the pressure reducing operation by the suction pump 115 is no longer being carried out, negative pressure is maintained in the air discharging passage 105. Therefore, even if the bubble 108 occurs in the ink storage space 104, it is purged into the air discharging passage 105 as soon as it comes into contact with the gas permeable member 106. Therefore, the bubble 108 stops accumulating in the ink storage space 104.

As described above, according to one of the characteristic features of the ink jet recording apparatus (ink delivery system) in this embodiment, even when the ink jet recording apparatus is not in operation, the bubble in the ink container can be continuously purged without wastefully consuming ink. Therefore, it is possible to provide a highly reliable ink jet recording apparatus. According to another characteristic feature, it does not occur that the bubble 108 grows (accumulates) large enough to occupy a significant amount of space in the ink storage space 104. Therefore, the ink container in this embodiment is superior in spatial efficiency. Thus, this characteristic feature makes it possible to provide an ink container which is significantly smaller than an ink container in accordance with the prior art. According to another characteristic feature, the negative pressure generating portion is a part of the main assembly of the ink jet recording apparatus, making it possible to reduce in size the amount of space which the portion of the gas purging portion occupies on the carriage. Therefore, the amount of space necessary for the recording head cartridge to move when it is printing is smaller than that in the first embodiment. Thus, this characteristic feature makes it possible to reduce an ink jet recording apparatus in overall size.

Incidentally, this embodiment also was described with reference to the recording apparatus employing an ink delivery system which intermittently deliver ink. However, this embodiment is not intended to limit the present invention in the type of ink jet recording apparatus to which the present invention is applicable. That is, the present invention is compatible with an ink jet recording apparatus, the ink container of which is on the carriage, as long as its ink container is provided with the gas permeable member.

Figure 9:
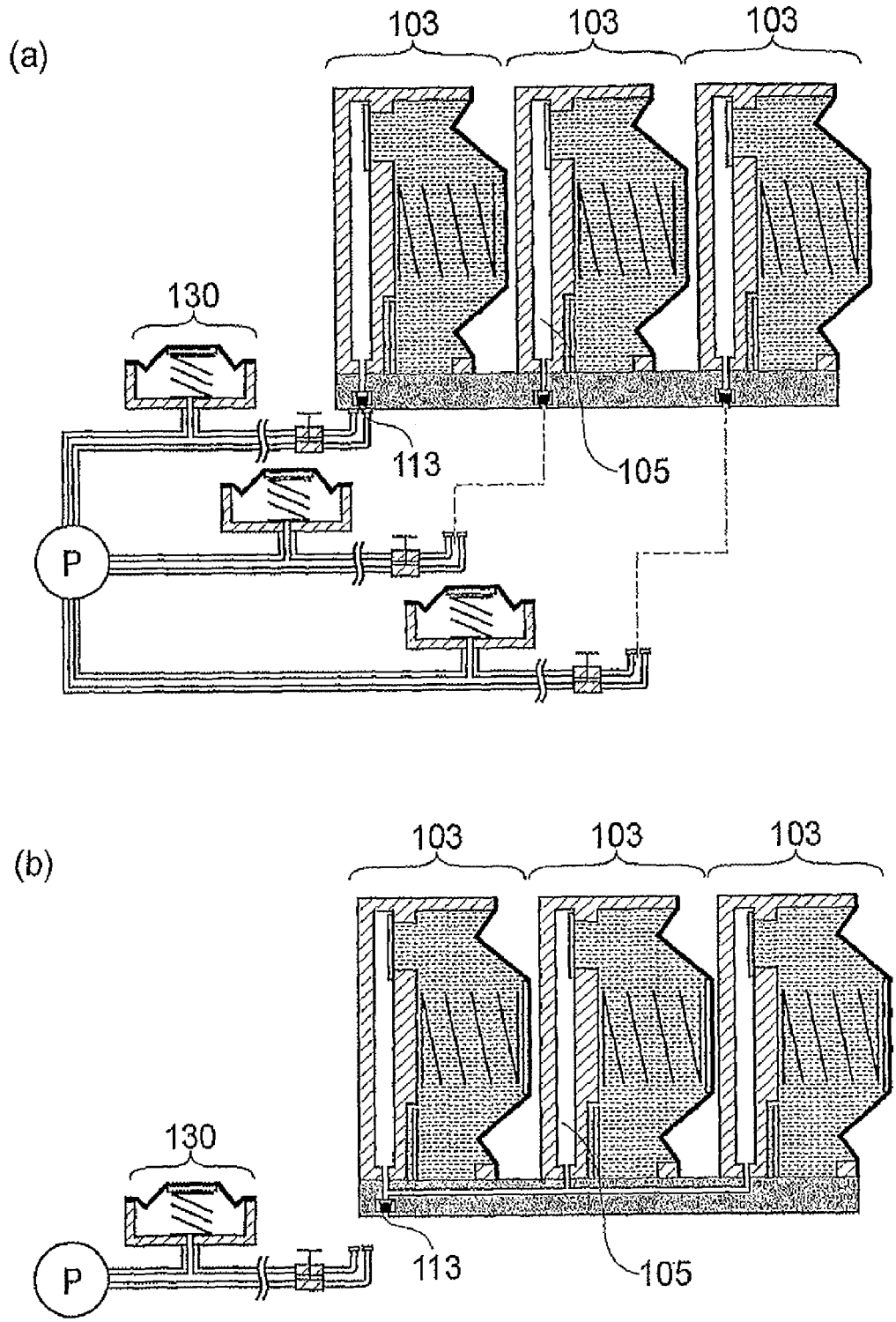
FIG. 9(*a*) is a schematic sectional view of the ink jet recording head, in the second embodiment of the present invention, which comprises multiple subordinate ink container and multiple negative pressure accumulating-and-storing portions, and FIG. 9(*b*) is a schematic sectional view of the ink jet recording head, in the second embodiment, which comprises multiple subordinate ink containers 103 and a single negative pressure accumulating-and-storing portion 130, showing the structures of the ink jet recording heads, respectively.

The present invention is also compatible with a recording head cartridge 129, shown in FIG. 9(*a*), which comprises multiple ink containers 130. In this case, each ink container 103 is provided with its own negative pressure storing portion 130, and is connected to its own air discharging passage 105. Therefore, it does not occur that the ink vapor generated in the air discharging passage 105 of one of the multiple ink containers 103 mixes with the ink vapor generated in the air discharging passage 105 of another ink container 103. Therefore, this structural arrangement is suitable for an ink jet recording apparatus in which the ink vapor from one ink is likely to react with the ink vapor from the other inks. Further, the present invention is compatible with an ink jet recording head unit 129, shown in FIG. 9(*b*), which is provided with only a common air discharging passage, to which the air discharging passage 105 of the negative pressure storing portion 130 of each ink container 130 is connected. Therefore, the bubbles 108 in all the ink containers 103 can be removed by a single negative pressure storing portion 130.

It is needless to say that the ink delivery systems (intermittent ink delivery system, continuous ink delivery system), the structures of the negative pressure storing portion 130, the structures of the means for generating negative pressure in the negative pressure storing portion 130, in the first embodiment, which were described above, are compatible with those in the second embodiment described above, and also, that they may be modified, as necessary, for their application to the ink jet recording apparatus in the second embodiment.

Embodiment 3

Figure 10:
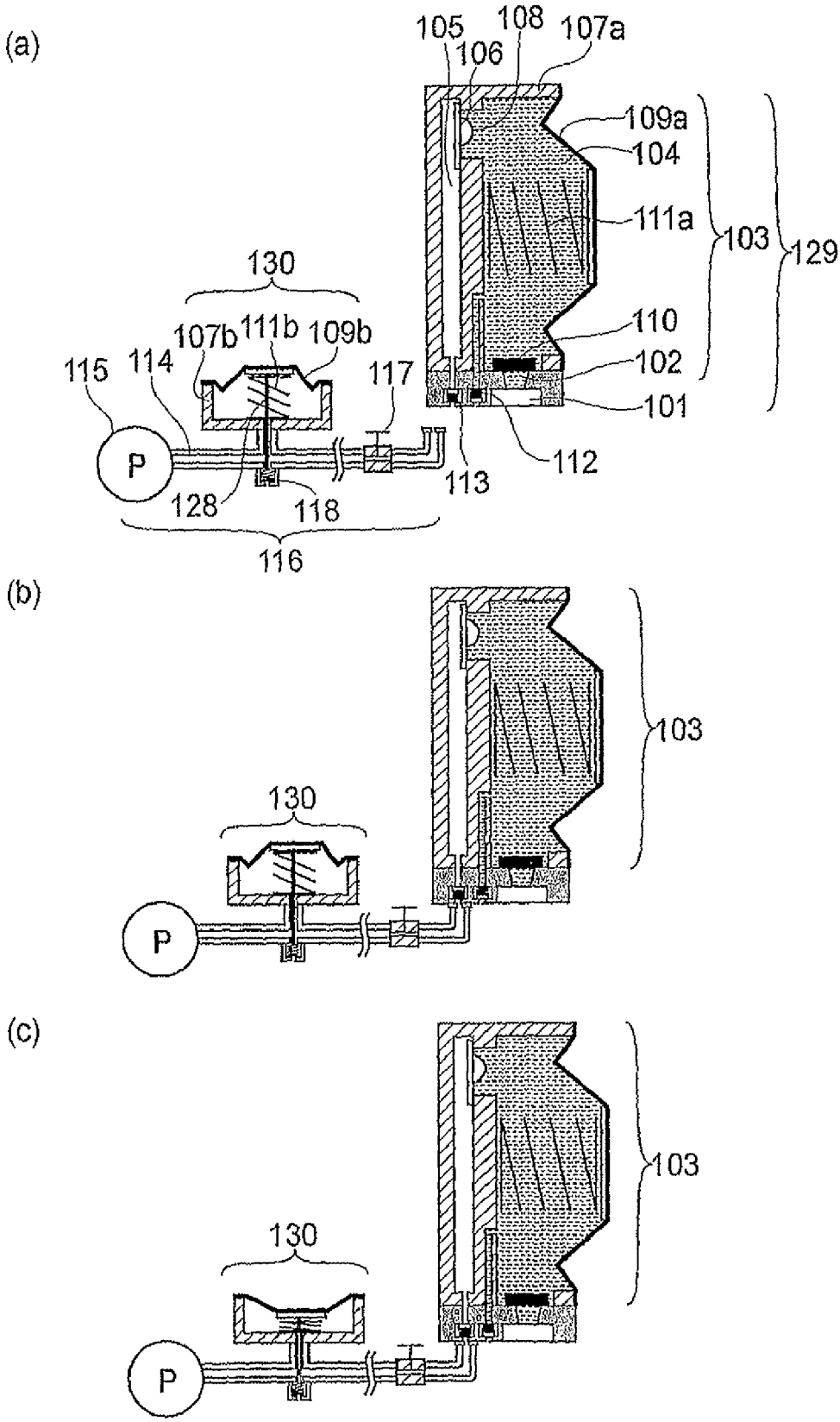
FIGS. 10(*a*)-10(*c*) are schematic sectional views of the ink delivery system, in the third embodiment of the present invention, showing the states of the ink delivery system before the ink jet recording head is connected to the suction pump, immediately after the ink jet recording head is connected to the suction pump, and while the suction pump is in operation, respectively.

FIGS. 10(*a*)-10(*c*) are schematic sectional views of the recording head cartridge and gas purging unit in the third embodiment of the present invention.

The ink container 103 in this embodiment is the same in structure as those in the first and second embodiments. However, the negative pressure storing portion 130 in this embodiment is different from that in the first embodiment, in that it is a part of the main assembly of an ink jet recording apparatus as it is in the second embodiment.

That is, the negative pressure storing portion 130 in this embodiment is connected to the connective tube 114 which is in connection with the suction pump 115. In terms of the lengthwise direction of the passage 114, the negative pressure storing portion 130 is positioned near the home position of the recording head unit 129, and serves as a gas purging unit 116.

The gas purging unit 116 is connectable with the air outlet 113 of the ink container 103. When the ink jet recording apparatus is not recording, for example, while it is on standby, more specifically, while the recording head unit is in its home position, the air purging unit 116 is kept connected to the air outlet 113. The air purging unit 116 is provided with the valve 117, which operates in such a manner that it opens only when the air purging unit 116 is in connection with the air outlet 113. Further, the air purging unit 116 is provided with a pressure adjustment valve 118, which operates in response to the change in the size of the internal space of the negative pressure storing portion 130. The pressure adjustment value 118 is attached to the opposite portion of the connective tube 114 from the negative pressure storing portion 130.

Next, the operation of the air purging unit 116 in this embodiment will be described with regard to its operation for purging a bubble 108 in the ink storage space 104 into the ambience. When the ink jet recording head is not recording, the recording head unit 129 is on standby in its home position, in which it is connectible with the external ink supply source 125 (FIG. 8(*a*)). It is while the recording head unit 129 is on standby that the operation for generating negative pressure in the air discharging passage 105 is started by connecting the air purging unit 116 to the air outlet 113 (FIG. 10(*b*)). If the bubble 108 in the ink storage space 104 is in contact with the gas permeable member 106 during this period, only the bubble 108 is extracted into the air discharging passage 105; it is separated from the body of ink in the ink storage space 104. Further, as negative pressure is generated in the air discharging passage 105, the flexible film 109*a* begins to flex in the direction to reduce the ink storage space 104 in internal space, causing thereby the negative pressure storing portion 130 to store negative pressure (FIG. 10(*c*)). Then, after the lapse of a preset length of time, the operation for generating negative pressure by the suction pump 115 is stopped. When the recording head unit 129 is not recording, the recording head unit 129 is in its home position, and the air purging unit 116 is in connection With the air outlet 113. Therefore, even if the pressure reducing operation by the suction pump 115 is no longer being carried out, negative pressure is maintained in the air discharging passage 105, making it possible to purge the ink storage space 104 of the bubble 108.

The negative pressure storing portion 130 is provided with a flexible film supporting rod 128, which is movable in the direction parallel to the direction in which the flexible film 109 deforms. One end of the supporting rod 128 is firmly attached to the flexible film 109, and the other is in contact with the pressure adjustment valve 118, the opening or closing of which is controllable.

With the provision of the above described structural arrangement, when the contraction of the negative pressure storing portion 130 is large, that is, when the negative pressure storing portion 130 is high in negative pressure, the rod 128 in the negative pressure storing portion 130 opens the pressure adjustment valve 118, connecting thereby the internal space of the negative pressure storing portion 130 with the ambience. As a result, the negative pressure storing portion 130 is adjusted in the amount of negative pressure; the negative pressure in the negative pressure storing portion 130 is reduced to a proper amount. Therefore, in the case of the air purging unit 116 in this embodiment, it is ensured that it does not occur that the amount of negative pressure in the air discharging passage 105 becomes greater than the amount of negative pressure large enough to cause the gas permeable member to allow the permeation of ink through the gas permeable member 106. Therefore, the bubble 108 in the ink storage space 104 can be continuously purged from the ink storage space 104 while preventing the problem that the gas permeable member 106 is permanently deformed by the excessive amount of negative pressure, and/or the problem that ink leaks from the recording head 101. In other words, the structure arrangement for the air purging unit 116 in this embodiment can achieve the same effects as those achieved by that in the second embodiment.

Incidentally, it is needless to say that the ink delivery systems (intermittent ink delivery system, continuous ink delivery system), the structures of the negative pressure storing portion 130, the structures of the means for generating negative pressure in the negative pressure storing portion 130, in the first embodiment, which were described above, are also compatible with those in the third embodiment described above, and also, that they may be modified, as necessary, for their application to the ink jet recording apparatus in the third embodiment.

Figure 11:
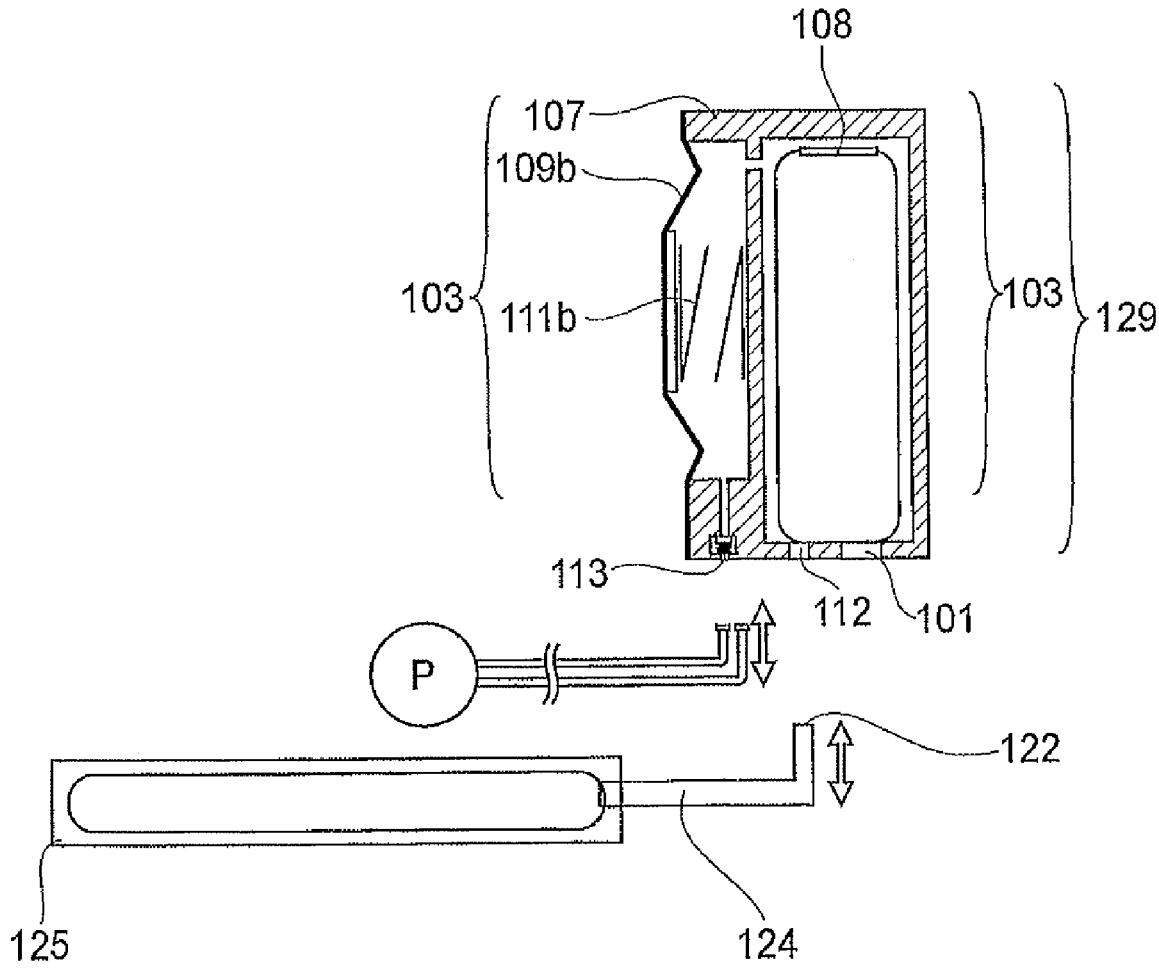
FIG. 11 is a schematic sectional view of an ink jet recording head, which is significantly different in structure from those in the first to third embodiments, and yet, is compatible with the present invention, showing the structure of the head.

FIG. 11 is a schematic sectional view of an ink container 103 structured differently from those in the preceding embodiments. The ink container 103 is produced by blow molding, such as the one disclosed in Japanese Laid-open Patent Application H09-267483. It is provided with a permeable member 108, which is placed in the ink container 103, and the internal space of the negative pressure storing portion 130 is connected to the internal space of the external shell portion of the ink storage portion to generate negative pressure in the negative pressure storing portion 130. Therefore, the bubble in the ink container can be purged from the ink container. The present invention is also applicable to the ink container shown in FIG. 11, in addition to those in the preceding embodiments. In other words, the present invention is any ink delivery system which intermittently delivers ink, as long as it is structured so that negative pressure can be generated on the ink container side.

Incidentally, in the case of the ink delivery system which continuously delivers ink, it is unnecessary for an ink container to be provided with a negative pressure source, since negative pressure can be generated by the difference in the head pressure between the body of ink in the subordinate ink container and that in the main ink container.

INDUSTRIAL APPLICABILITY

According to the present invention, it is possible to provide an ink storing system and an ink delivery system, which are capable of removing the bubbles in the subordinate ink container whether the power source of an ink jet recording apparatus is on or off, and also, even if an ink jet recording apparatus is left unused for a long time.

While the invention has been described with reference to the structures disclosed herein, it is not confined to the details set forth, and this application is intended to cover such modifications or changes as may come within the purposes of the improvements or the scope of the following claims.

The invention claimed is:

1. An ink reservoir mechanism comprising:

a ink reservoiring portion for directly reservoiring ink to be supplied to an ink jet recording head, said ink reservoiring portion having a reservoiring volume which reduces with consumption of the ink and being provided with an air-liquid separation device;

a negative pressure source, having a variable inner volume, for normally applying a negative pressure to said ink reservoiring portion through said air-liquid separation device; and a connection path for connecting said negative pressure source and said ink reservoiring portion through said air-liquid separation device, wherein said negative pressure source comprises a flexible film and an internal elastic member, and is effective to discharge the air through said air-liquid separation device from said ink reservoiring portion by applying the negative pressure to said ink reservoiring portion through said connection path by changing the inner volume, and wherein said negative pressure source includes a one-way valve for permitting flow of the air from an inside thereof to an outside thereof while preventing flow of the air from the outside to the inside, and wherein the negative pressure is produced by displacing said flexible film and said elastic member in a direction of reducing the inner volume of said negative pressure source.

2. A mechanism according to claim 1, wherein said negative pressure source is common for a plurality of such said ink reservoiring portions.

3. An ink supplying system for supplying ink from an ink container to an ink jet recording head, said system comprising:

an ink reservoiring portion for directly reservoiring ink to be supplied to an ink jet recording head, said ink reservoiring portion having a reservoiring volume which reduces with consumption of the ink and being provided with an air-liquid separation device;

a negative pressure source, having a variable inner volume, for normally applying a negative pressure to said ink reservoiring portion through said air-liquid separation device;

a connection path for connecting said negative pressure source and said ink reservoiring portion through said air-liquid separation device;

a displacement mechanism for displacement in a direction of reducing an inner volume of said negative pressure source; and a main container for reservoiring ink to be supplied to said ink reservoiring portion, wherein said negative pressure source comprises a flexible film and an internal elastic member, and is effective to discharge the air through said air-liquid separation device from said ink reservoiring portion by applying the negative pressure to said ink reservoiring portion through said connection path by changing the inner volume, and wherein said negative pressure source includes a one-way valve for permitting flow of the air from an inside thereof to an outside thereof while preventing flow of the air from the outside to the inside, and wherein the negative pressure is produced by displacing said flexible film and said elastic member in a direction of reducing the inner volume of said negative pressure source.

4. A system according to claim 3, wherein said air-liquid separation device is disposed at a position which is reached by the air in said ink reservoiring portion.

5. A system according to claim 3, wherein said displacement mechanism functions as a second negative pressure source connected with said unidirectional valve and effective to discharge the air from an inside of said first mentioned negative pressure source.

6. An apparatus according to claim 5, wherein said second negative pressure source is normally connected with said connection path.

7. A system according to claim 5, wherein said second negative pressure source is movable to and away from said connection path.

8. A system according to claim 3, wherein said displacement mechanism is a pressurizing source for discharging the air from an inside of said negative pressure source by pressing said flexible film from an outside.

9. A system according to claim 3, wherein said ink reservoiring portion and said main container are connectable with and disconnectable from each other.

10. A system according to claim 3, wherein said ink reservoiring portion and said main container are normally connected with each other.

11. A system according to claim 3, wherein said negative pressure source is common for a plurality of such said ink reservoiring portions.

12. A system according to claim 3, wherein said displacement mechanism is common for a plurality of sets each including said ink reservoiring portion and said negative pressure source.

13. A system according to claim 3, further comprising a carriage for carrying an ink jet recording head, wherein said negative pressure source is provided on said carriage together with said ink reservoiring portion.

14. An apparatus according to claim 3, further comprising a carriage for carrying an ink jet recording head, wherein said negative pressure source is provided outside said carriage.

* * * * *